US009658557B2

(12) United States Patent
Futamata

(10) Patent No.: US 9,658,557 B2
(45) Date of Patent: May 23, 2017

(54) SEMICONDUCTIVE ROLLER

(71) Applicant: SUMITOMO RUBBER INDUSTRIES, LTD., Kobe-shi, Hyogo (JP)

(72) Inventor: Kazuo Futamata, Kobe (JP)

(73) Assignee: SUMITOMO RUBBER INDUSTRIES, LTD., Kobe-shi (JP)

( * ) Notice: Subject to any disclaimer, the term of this patent is extended or adjusted under 35 U.S.C. 154(b) by 0 days.

(21) Appl. No.: 15/058,953

(22) Filed: Mar. 2, 2016

(65) Prior Publication Data

US 2016/0274480 A1 Sep. 22, 2016

(30) Foreign Application Priority Data

Mar. 17, 2015 (JP) ..... 2015-053726

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
USPC ..... 399/176
See application file for complete search history.

(56) References Cited

U.S. PATENT DOCUMENTS

2004/0106708 A1 6/2004 Mizumoto et al.
2006/0074162 A1 4/2006 Mizumoto et al.
2014/0113783 A1* 4/2014 Mizumoto ..... C08J 3/246 492/18
2014/0342892 A1* 11/2014 Tajima ..... G03G 15/0233 492/18

FOREIGN PATENT DOCUMENTS

JP 2001-215776 A 8/2001
JP 2004-176056 A 6/2004

* cited by examiner

*Primary Examiner* — Hoang Ngo
(74) *Attorney, Agent, or Firm* — Birch, Stewart, Kolasch & Birch, LLP

(57) ABSTRACT

A semiconductive roller is provided, which is capable of uniformly electrically charging a surface of a photoreceptor body particularly when being used as a charging roller, substantially free from defective image formation due to adhesion and accumulation of external additives even if repeatedly performing a charging operation, and less liable to contaminate the photoreceptor body, and has a lower roller resistance to make it possible to form higher-definition images at a higher process speed. The semiconductive roller (1) is formed from a semiconductive rubber composition which contains a rubber component including 15 to 80 mass % of an epichlorohydrin rubber, 5 to 50 parts by mass of titanium oxide based on 100 parts by mass of the rubber component, and a potassium salt as an electrically conductive agent. The semiconductive roller (1) has an oxide film (5) provided in an outer peripheral surface (4) thereof.

5 Claims, 1 Drawing Sheet

SEMICONDUCTIVE ROLLER

TECHNICAL FIELD

The present invention relates to a semiconductive roller to be used particularly as a charging roller in an electrophotographic image forming apparatus such as a laser printer, an electrostatic copying machine, a plain paper facsimile machine or a printer-copier-facsimile multifunction machine.

BACKGROUND ART

In the image forming apparatus, a semiconductive roller produced, for example, by molding a semiconductive rubber composition into a tubular body, crosslinking the tubular body, and inserting a shaft such as of a metal into a center through-hole of the tubular body is generally used as a charging roller for uniformly electrically charging a surface of a photoreceptor body, as a developing roller for developing an electrostatic latent image formed by exposing the electrically charged photoreceptor surface into a toner image, as a transfer roller for transferring the formed toner image onto a paper sheet or the like, or as a cleaning roller for removing toner from the photoreceptor surface after the transfer of the toner image onto the paper sheet, or the like.

In general, the semiconductive rubber composition to be used as a material for the semiconductive roller is imparted with ion conductivity by using an ion-conductive rubber such as an epichlorohydrin rubber as a rubber component.

Further, a diene rubber is generally used in combination with the ion-conductive rubber as the rubber component in order to improve the mechanical strength and the durability of the semiconductive roller or to improve the rubber characteristic properties of the semiconductive roller, i.e., to make the semiconductive roller more flexible and less susceptible to compression set or permanent compressive deformation.

Further, an outer peripheral surface of the semiconductive roller is generally coated with a coating film such as of a urethane resin.

The coverage of the outer peripheral surface of the semiconductive roller with the coating film is advantageous for the following reason. When the semiconductive roller is used as the charging roller or the like in direct contact with the photoreceptor body, the image formation is prevented from being adversely influenced by contamination of the photoreceptor body with substances bleeding or blooming on the outer peripheral surface from the inside of the semiconductive roller.

Further, minute particles (external additives) such as of silica and titanium oxide added to the toner for improvement of the fluidity and the electrical chargeability of the toner, or broken toner particles (which are hereinafter collectively referred to as "external additives") are prevented from adhering to the outer peripheral surface of the semiconductive roller and gradually accumulating on the outer peripheral surface, thereby preventing the adverse influence on the image formation.

The coating film is generally formed by applying a coating liquid onto the outer peripheral surface of the semiconductive roller by a coating process such as a spraying method or a dipping method, and then drying the coating liquid. Therefore, the coating film is liable to suffer from contamination with dust and other foreign matter, uneven thickness and other defects during the coating process. Particularly, if the semiconductive roller suffering from any of these defects is used as the charging roller, it is impossible to uniformly electrically charge the surface of the photoreceptor body. Problematically, this may result in defective image formation such as uneven image density.

In addition, the coating film formation technique, which is an established technique, has little room for improvement. Therefore, it is difficult to significantly reduce the incidence of the defects (defect percentage) as compared with the current technique. This may reduce the yield and the productivity of the semiconductive roller to increase the production costs.

In compact and less expensive laser printers and the like for use in small offices and for personal use, the coating film is entirely obviated for cost reduction, or a thin oxide film is formed instead of the coating film (see, for example, Patent Document 1).

Where the semiconductive roller is formed from the semiconductive rubber composition containing the diene rubber as the rubber component, the oxide film is formed in the outer peripheral surface of the semiconductive roller by irradiating the outer peripheral surface with energy radiation such as ultraviolet radiation or electron radiation to oxidize the diene rubber in the outer peripheral surface.

This eliminates the possibility that the oxide film is contaminated with dust and other foreign matter during the formation of the oxide film. Further, the oxidation reaction uniformly proceeds in the outer peripheral surface of the semiconductive roller, thereby eliminating the possibility that the oxide film has variations in thickness. Particularly, where the semiconductive roller is used as the charging roller, the surface of the photoreceptor body can be uniformly electrically charged, thereby advantageously preventing the defective image formation such as image density unevenness.

However, the crosslinked rubber has higher friction, and is highly adhesive. Where the coating film is obviated or the thin oxide film is formed instead of the coating film, the external additives are liable to adhere to the outer peripheral surface of the semiconductive roller to gradually accumulate on the outer peripheral surface. This problem is particularly remarkable in the case of the charging roller which is constantly kept in contact with the surface of the photoreceptor body.

The accumulating external additives may influence the characteristic properties of the semiconductive roller, e.g., the capability of the charging roller for charging the photoreceptor body. Further, the accumulating external additives may adhere again on an image formed on a paper sheet, or may cause defective image formation.

In recent years, image forming apparatuses are required to form higher-definition images at a higher process speed (at a higher image formation speed), and constituent components of the image forming apparatuses are required to be more durable. Therefore, the charging roller and the like are required to have a lower roller resistance for the higher process speed and for the higher-definition image formation, and required to be substantially free from reduction in performance due to the adhesion and the accumulation of the external additives and capable of suppressing the defective image formation for a longer period of time.

CITATION LIST

Patent Document

[PATENT DOCUMENT 1] JP-2004-176056A
[PATENT DOCUMENT 2] JP-2001-215776A

SUMMARY OF THE INVENTION

Problem to be Solved by the Invention

It is an object of the present invention to provide a semiconductive roller which is capable of uniformly electrically charging the surface of the photoreceptor body particularly when being used as a charging roller, substantially free from the defective image formation due to the adhesion and the accumulation of the external additives even if repeatedly performing the charging operation, less liable to contaminate the photoreceptor body, and has a lower roller resistance to make it possible to form higher-definition images at a higher process speed.

Solution to Problem

According to the present invention, there is provided a semiconductive roller, which includes: a roller body formed from a semiconductive rubber composition; and an oxide film provided in an outer peripheral surface of the roller body; wherein the semiconductive rubber composition comprises a rubber component including an epichlorohydrin rubber and a diene rubber, an electrically conductive agent including a potassium salt of an anion having a fluoro group and a sulfonyl group in its molecule, titanium oxide, and a crosslinking component for crosslinking the rubber component; wherein the epichlorohydrin rubber is present in a proportion of not less than 15 mass % and not greater than 80 mass % in the rubber component; wherein the titanium oxide is present in a proportion of not less than 5 parts by mass and not greater than 50 parts by mass based on 100 parts by mass of the overall rubber component in the semiconductive rubber composition.

Effects of the Invention

According to the present invention, the semiconductive roller is capable of uniformly electrically charging the surface of the photoreceptor body particularly when being used as a charging roller, substantially free from the defective image formation due to the adhesion and the accumulation of the external additives even if repeatedly performing the charging operation, less liable to contaminate the photoreceptor body, and has a lower roller resistance to make it possible to form higher-definition images at a higher process speed.

EMBODIMENTS OF THE INVENTION

Figure 1:
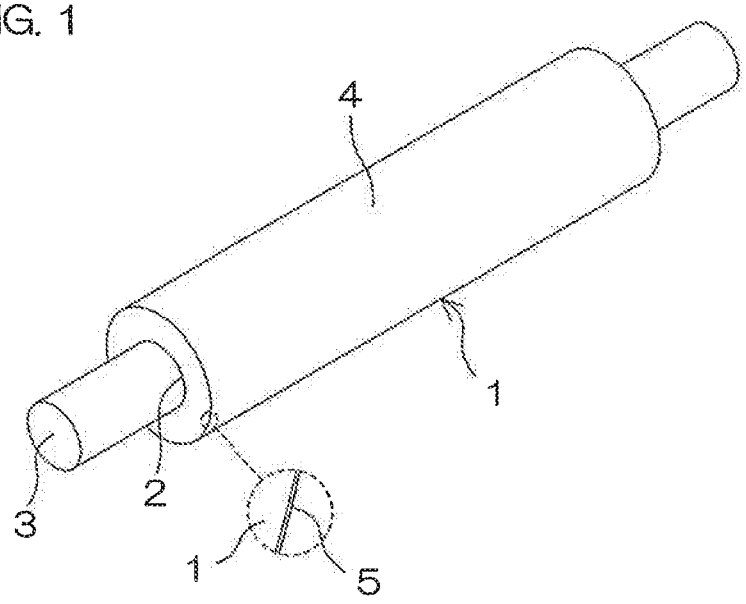
FIG. 1 is a perspective view illustrating an exemplary semiconductive roller according to one embodiment of the present invention.

The inventive semiconductive roller includes: a roller body formed from a semiconductive rubber composition; and an oxide film provided in an outer peripheral surface of the roller body. The semiconductive rubber composition comprises: a rubber component including an epichlorohydrin rubber and a diene rubber; an electrically conductive agent including a potassium salt of an anion having a fluoro group and a sulfonyl group in its molecule; titanium oxide; and a crosslinking component for crosslinking the rubber component. The epichlorohydrin rubber is present in a proportion of not less than 15 mass % and not greater than 80 mass % in the rubber component. The titanium oxide is present in a proportion of not less than 5 parts by mass and not greater than 50 parts by mass based on 100 parts by mass of the overall rubber component in the semiconductive rubber composition.

According to the present invention, the potassium salt of the anion (hereinafter sometimes referred to simply as "potassium salt") is blended as the electrically conductive agent in the semiconductive rubber composition containing the epichlorohydrin rubber in the predetermined proportion as the rubber component, whereby the roller resistance is further reduced to make it possible to form higher-definition images at a higher process speed.

In the present invention, the proportion of the epichlorohydrin rubber in the rubber component is limited to not less than 15 mass % for the following reason. If the proportion of the epichlorohydrin rubber is less than this range, the roller resistance will be significantly increased by repeated charging operation even with the addition of the potassium salt, making it impossible to impart the charging roller with proper semiconductivity.

The proportion of the epichlorohydrin rubber in the rubber component is limited to not greater than 80 mass % for the following reason. If the proportion of the epichlorohydrin rubber is greater than this range, the proportion of the diene rubber which is essential for the formation of the oxide film is relatively reduced. Therefore, the oxide film formed in the outer peripheral surface of the semiconductive roller fails to sufficiently function as a protective film, so that the semiconductive roller is liable to contaminate the photoreceptor body and suffer from the adhesion and the accumulation of the external additives on the outer peripheral surface thereof.

Where the proportion of the epichlorohydrin rubber in the rubber component is not less than 15 mass % and not greater than 80 mass %, in contrast, the semiconductive roller is imparted with proper semi conductivity, and the oxide film formed in the outer peripheral surface of the semiconductive roller sufficiently functions as the protective film.

For further improvement of these effects, the proportion of the epichlorohydrin rubber in the rubber component is preferably not less than 50 mass % and not greater than 70 mass %.

In the present invention, the electrically conductive agent is limited to the potassium salt for the following reason. The potassium salt is less hygroscopic and non-deliquescent unlike a lithium salt of an anion having a fluoro group and a sulfonyl group in its molecule. Therefore, the potassium salt is substantially free from deliquescence in a higher-temperature and higher-humidity environment and hence blooming on the outer peripheral surface of the semiconductive roller. Thus, the semiconductive roller is less liable to contaminate the photoreceptor body.

Without the possibility that the potassium salt suffers from change in weight due to the moisture absorption and deliquescence during the weighing thereof, it is easier to accurately weigh the potassium salt. Further, the semiconductive rubber composition is less liable to suffer from batch-to-batch variations in moisture absorption. Therefore, the potassium salt is excellent in handlability.

According to the present invention, the distinct rubber characteristic properties of the semiconductive roller is moderately suppressed by the addition of the predetermined proportion of the titanium oxide, whereby the friction and the adhesiveness of the outer peripheral surface are reduced.

As well known, the titanium oxide serves as a photocatalyst, particularly, to assist the formation of the oxide film by the irradiation with the ultraviolet radiation. Therefore, a firm oxide film capable of properly preventing the adhesion of the external additives can be efficiently formed in the outer peripheral surface by the irradiation with the ultraviolet radiation. Even if the semiconductive roller repeatedly performs the charging operation, the defective image formation due to the adhesion and the accumulation of the external additives is less liable to occur.

In the present invention, the proportion of the titanium oxide is limited to not less than 5 parts by mass based on 100 parts by mass of the overall rubber component for the following reason. If the proportion of the titanium oxide is less than this range, it will be impossible to provide the aforementioned effects. The semiconductive roller is liable to suffer from the adhesion and the accumulation of the external additives particularly when being used as the charging roller to repeatedly perform the charging operation.

The proportion of the titanium oxide is limited to not greater than 50 parts by mass based on 100 parts by mass of the overall rubber component for the following reason. If the proportion of the titanium oxide is greater than this range, the semiconductive roller will suffer from a greater compression set. When the semiconductive roller serving as the charging roller is kept in press contact with the photoreceptor body during the stop of the image forming apparatus and then is rotated to be brought out of the press contact, for example, a press contact portion of the charging roller is not restored to its original state. That is, the charging roller is liable to suffer from so-called permanent compressive deformation.

Where the proportion of the titanium oxide is not less than 5 parts by mass and not greater than 50 parts by mass based on 100 parts by mass of the overall rubber component, in contrast, the semiconductive roller is substantially free from the permanent compressive deformation with a reduced compression set. Even if the semiconductive roller repeatedly performs the charging operation, the defective image formation due to the adhesion and the accumulation of the external additives is less liable to occur.

For further improvement of these effects, the proportion of the titanium oxide is preferably not less than 10 parts by mass and not greater than 30 parts by mass based on 100 parts by mass of the overall rubber component.

The use of the titanium oxide for the charging roller is already described, for example, in Patent Document 2.

In Patent Document 2, however, the use of the titanium oxide merely aims at decomposing a discharge product occurring in the vicinity of the surface of the photoreceptor body during the charging operation by the photo-catalytic effect of the titanium oxide to remove the discharge product.

In Patent Document 2, there is no description that the titanium oxide functions as a filler to suppress the distinct rubber characteristic properties of the semiconductive roller to thereby reduce the friction and the adhesiveness of the outer peripheral surface, and assists the formation of the oxide film by the irradiation with the ultraviolet radiation.

In Patent Document 2, it is described that the outer peripheral surface of the charging roller is coated with a thin film of the titanium oxide, or the titanium oxide is contained only in the outer peripheral surface to provide the aforementioned effects. With this arrangement, however, the titanium oxide does not function as the filler, failing to suppress the distinct rubber characteristic properties of the semiconductive roller and thereby reduce the friction and the adhesiveness of the outer peripheral surface.

Further, Patent Document 2 does not intend to form the oxide film in the outer peripheral surface of the charging roller, because the formation of the oxide film impairs the effect of Patent Document 2.

According to the present invention, the semiconductive roller is capable of uniformly electrically charging the surface of the photoreceptor body particularly when being used as the charging roller, substantially free from the defective image formation due to the adhesion and the accumulation of the external additives even if repeatedly performing the charging operation, and less liable to contaminate the photoreceptor body, and has a lower roller resistance to make it possible to form higher-definition images at a higher process speed.

<<Semiconductive Rubber Composition>>

<Rubber Component>

As described above, the epichlorohydrin rubber and the diene rubber are used in combination as the rubber component.

(Epichlorohydrin Rubber)

Various ion-conductive polymers having epichlorohydrin as a repeating unit are usable as the epichlorohydrin rubber.

Examples of the epichlorohydrin rubber include epichlorohydrin homopolymers, epichlorohydrin-ethylene oxide bipolymers (ECO), epichlorohydrin-propylene oxide bipolymers, epichlorohydrin-allyl glycidyl ether bipolymers, epichlorohydrin-ethylene oxide-allyl glycidyl ether terpolymers (GECO), epichlorohydrin-propylene oxide-allyl glycidyl ether terpolymers and epichlorohydrin-ethylene oxide-propylene oxide-allyl glycidyl ether quaterpolymers, which may be used alone or in combination.

Of these epichlorohydrin rubbers, the ethylene oxide-containing copolymers, particularly the ECO and/or the GECO are preferred.

These copolymers preferably each have an ethylene oxide content of not less than 30 mol % and not greater than 80 mol %, particularly preferably not less than 50 mol %.

Ethylene oxide functions to reduce the roller resistance of the semiconductive roller. If the ethylene oxide content is less than the aforementioned range, however, it will be impossible to sufficiently provide this function and hence to sufficiently reduce the roller resistance.

If the ethylene oxide content is greater than the aforementioned range, on the other hand, ethylene oxide is liable to be crystallized, whereby the segment motion of molecular chains is hindered to adversely increase the roller resistance. Further, the semiconductive roller is liable to have an excessively high hardness after the crosslinking, and the semiconductive rubber composition is liable to have a higher viscosity and, hence, poorer processability when being heat-melted before the crosslinking.

The ECO has an epichlorohydrin content that is a balance obtained by subtracting the ethylene oxide content from the total. That is, the epichlorohydrin content is preferably not less than 20 mol % and not greater than 70 mol %, particularly preferably not greater than 50 mol %.

The GECO preferably has an allyl glycidyl ether content of not less than 0.5 mol % and not greater than 10 mol %, particularly preferably not less than 2 mol % and not greater than 5 mol %.

Allyl glycidyl ether per se functions as side chains of the copolymer to provide a free volume, whereby the crystallization of ethylene oxide is suppressed to reduce the roller resistance of the semiconductive roller. However, if the allyl glycidyl ether content is less than the aforementioned range, it will be impossible to provide this function and hence to sufficiently reduce the roller resistance.

Allyl glycidyl ether also functions as crosslinking sites during the crosslinking of the GECO. Therefore, if the allyl glycidyl ether content is greater than the aforementioned range, the crosslinking density of the GECO is excessively increased, whereby the segment motion of molecular chains is hindered to adversely increase the roller resistance.

The GECO has an epichlorohydrin content that is a balance obtained by subtracting the ethylene oxide content and the allyl glycidyl ether content from the total. That is, the epichlorohydrin content is preferably not less than 10 mol % and not greater than 69.5 mol %, particularly preferably not less than 19.5 mol % and not greater than 60 mol %.

Examples of the GECO include copolymers of the three comonomers described above in a narrow sense, as well as known modification products obtained by modifying an epichlorohydrin-ethylene oxide copolymer (ECO) with allyl glycidyl ether. In the present invention, any of these modification products may be used as the GECO.

The GECO is particularly preferred as the epichlorohydrin rubber. The GECO has double bonds, in its main chains, attributable to allyl glycidyl ether to function as the crosslinking sites and, therefore, reduces the compression set of the semiconductive roller by crosslinking between the main chains.

Therefore, the semiconductive roller is less liable to suffer from the permanent compressive deformation, for example, when being used as the charging roller. Thus, the defective image formation such as the image density unevenness can be suppressed which may otherwise occur due to the permanent compressive deformation.

(Diene Rubber)

Examples of the diene rubber include a natural rubber, an isoprene rubber (IR), a butadiene rubber (BR), a styrene butadiene rubber (SBR), a chloroprene rubber (CR) and an acrylonitrile butadiene rubber (NBR), which may be used alone or in combination.

Particularly, the NBR is preferably used alone or in combination with the CR. The CR and the NBR are particularly preferably used in combination.

That is, the epichlorohydrin rubber, the CR and the NBR are used in combination as the rubber component. Two or more types of different grades of each of these rubbers may be used in combination.

Where these rubbers are used in combination, the CR which contains a great number of chlorine atoms in its molecule functions as the diene rubber, and functions to improve the charging characteristics of the semiconductive roller particularly when the inventive semiconductive roller is used as the charging roller.

Further, the NBR has a particularly excellent function as the diene rubber, i.e., a particularly excellent function for forming an excellent oxide film as the protective film in the outer peripheral surface of the semiconductive roller through the oxidation by the irradiation with the ultraviolet radiation.

The CR and the NBR, which are polar rubbers, have a function for finely controlling the roller resistance of the semiconductive roller.

The CR is generally synthesized by emulsion polymerization of chloroprene, and may be classified in a sulfur modification type or a non-sulfur-modification type depending on the type of a molecular weight adjusting agent to be used for the emulsion polymerization.

The sulfur modification type CR is prepared by plasticizing a copolymer of chloroprene and sulfur (molecular weight adjusting agent) with thiuram disulfide or the like to adjust the viscosity of the copolymer to a predetermined viscosity level.

The non-sulfur-modification type CR may be classified, for example, in a mercaptan modification type, a xanthogen modification type or the like.

The mercaptan modification type CR is synthesized in substantially the same manner as the sulfur modification type CR, except that an alkyl mercaptan such as n-dodecyl mercaptan, tert-dodecyl mercaptan or octyl mercaptan, for example, is used as the molecular weight adjusting agent.

The xanthogen modification type CR is synthesized in substantially the same manner as the sulfur modification type CR, except that an alkyl xanthogen compound is used as the molecular weight adjusting agent.

Further, the CR may be classified in a lower crystallization speed type, an intermediate crystallization speed type or a higher crystallization speed type depending on the crystallization speed.

In the present invention, any of the aforementioned types of CRs may be used. Particularly, a CR of the non-sulfur-modification type and the lower crystallization speed type is preferred.

Further, a copolymer of chloroprene and other comonomer may be used as the CR. Examples of the other comonomer include 2,3-dichloro-1,3-butadiene, 1-chloro-1,3-butadiene, styrene, acrylonitrile, methacrylonitrile, isoprene, butadiene, acrylic acid, acrylates, methacrylic acid and methacrylates, which may be used alone or in combination.

Any of lower-acrylonitrile-content NBRs having an acrylonitrile content of not greater than 24%, an intermediate-acrylonitrile-content NBRs having an acrylonitrile content of 25 to 30%, intermediate- and higher-acrylonitrile-content NBRs having an acrylonitrile content of 31 to 35%, higher-acrylonitrile-content NBRs having an acrylonitrile content of 36 to 42%, and very-high-acrylonitrile-content NBRs having an acrylonitrile content of not lower than 43% may be used as the NBR.

(Proportions of Rubbers for Rubber Component)

The proportion of the epichlorohydrin rubber to be blended as the rubber component is preferably not less than 15 mass % and not greater than 80 mass %, particularly preferably not less than 50 mass % and not greater than 70 mass %, based on the overall amount of the rubber component.

Where the epichlorohydrin rubber, the CR and the NBR are used in combination, the proportion of the CR is preferably not less than 10 mass % and not greater than 40 mass %, particularly preferably not greater than 30 mass % based on the overall amount of the rubber component.

If the proportion of the CR is less than the aforementioned range, it will be impossible to sufficiently provide the effects of the addition of the CR, i.e., for improving the charging characteristics when the semiconductive roller is used as the charging roller and for finely controlling the roller resistance.

If the proportion of the CR is greater than the aforementioned range, on the other hand, the proportion of the epichlorohydrin rubber is relatively reduced, making it impossible to impart the semiconductive roller with ion conductivity suitable particularly for the charging roller.

The proportion of the NBR to be blended is a balance obtained by subtracting the amounts of the epichlorohydrin rubber and the CR from the total. That is, the proportion of the NBR may be determined so that the total amount of the epichlorohydrin rubber, the CR and the NBR for the rubber component is 100 mass % when the proportions of the epichlorohydrin rubber and the CR are predetermined.

<Potassium Salt>

Examples of the anion of the potassium salt having the fluoro group and the sulfonyl group in its molecule include fluoroalkyl sulfonate ions, bis(fluoroalkylsulfonyl)imide ions and tris(fluoroalkylsulfonyl)methide ions, which may be used alone or in combination.

Examples of the fluoroalkyl sulfonate ions include $CF_3SO_3^-$ and $C_4F_9SO_3^-$, which may be used alone or in combination.

Examples of the bis(fluoroalkylsulfonyl)imide ions include $(CF_3SO_2)_2N^-$, $(C_2F_5SO_2)_2N^-$, $(C_4F_9SO_2)(CF_3SO_2)N^-$, $(FSO_2C_6F_4)(CF_3SO_2)N^-$, $(C_8F_{17}SO_2)(CF_3SO_2)N^-$, $(CF_3CH_2OSO_2)_2N^-$, $(CF_3CF_2CH_2OSO_2)_2N^-$, $(HCF_2CF_2CH_2OSO_2)_2N^-$ and $[(CF_3)_2CHOSO_2]_2N^-$, which may be used alone or in combination.

Examples of the tris(fluoroalkylsulfonyl)methide ions include $(CF_3SO_2)_3C^-$ and $(CF_3CH_2OSO_2)_3C^-$, which may be used alone or in combination.

Preferred examples of the potassium salt include potassium bis (fluorosulfonyl) imides such as $(CF_3SO_2)_2NK$ (potassium bis (trifluoromethanesulfonyl)imide) for improvement of the ion conductivity of the semiconductive rubber composition for reduction of the roller resistance of the semiconductive roller.

The proportion of the potassium salt to be blended is preferably not less than 0.1 part by mass and not greater than 6 parts by mass, particularly preferably not less than 0.5 parts by mass and not greater than 5 parts by mass, based on 100 parts by mass of the overall rubber component.

If the proportion of the potassium salt is less than the aforementioned range, it will be impossible to sufficiently provide the effect of the addition of the potassium salt for further reducing the roller resistance of the semiconductive roller to make it possible to form higher-definition images at a higher process speed.

If the proportion of the potassium salt is greater than the aforementioned range, on the other hand, an excess amount of the potassium salt is liable to bloom on the outer peripheral surface of the semiconductive roller to contaminate the photoreceptor body.

Where the proportion of the potassium salt falls within the aforementioned range, in contrast, the roller resistance of the semiconductive roller can be reduced as much as possible, making it possible to form higher-definition images at a higher process speed. Further, the blooming can be suppressed.

<Titanium Oxide>

Usable as the titanium oxide are various types of titanium oxides which function as the filler.

Usable examples of the titanium oxides according to classification based on a preparation method include titanium oxide prepared by a sulfuric acid method, titanium oxide prepared by a chlorine method, and titanium oxides prepared by low-temperature oxidation (thermal decomposition, hydrolysis or the like) of volatile titanium compounds such as a titanium alkoxide, a titanium halide and titanium acetylacetonate.

Usable examples of the titanium oxides according to classification based on a crystal form include titanium oxides of an anatase form, a rutile form, an anatase/rutile mixed crystal form and an amorphous form.

Particularly, the titanium oxide of the anatase form is preferred, which has a strong photo-catalysis effect for assisting the formation of the oxide film by the irradiation with the ultraviolet radiation as described above.

The proportion of the titanium oxide to be blended is limited to a range of not less than 5 parts by mass and not greater than 50 parts by mass, particularly preferably not less than 10 parts by mass and not greater than 30 parts by mass, based on 100 parts by mass of the overall rubber component, for the aforementioned reasons.

<Crosslinking Component>

A thiourea crosslinking agent for mainly crosslinking the epichlorohydrin rubber, a sulfur crosslinking agent for crosslinking the diene rubber and the GECO of the epichlorohydrin rubber and the like, and accelerating agents for these crosslinking agents are preferably used in combination as the crosslinking component.

(Thiourea Crosslinking Agent and Accelerating Agent)

Various compounds each having a thiourea group in a molecule thereof and functioning as a crosslinking agent for the epichlorohydrin rubber are usable as the thiourea crosslinking agent.

Examples of the thiourea crosslinking agent include tetramethylthiourea, trimethylthiourea, ethylene thiourea (also referred to as 2-mercaptoimidazoline), and thioureas represented by the following formula (1):

$$(C_nH_{2n+1}NH)_2C{=}S \quad (1)$$

wherein n is an integer of 1 to 10. These thiourea crosslinking agents may be used alone or in combination. Particularly, ethylene thiourea is preferred.

In order to properly crosslink the epichlorohydrin rubber and to impart the semiconductive roller with rubber characteristic properties, i.e., to ensure that the semiconductive roller is flexible and substantially free from the permanent compressive deformation with a reduced compression set, the proportion of the thiourea crosslinking agent to be blended is preferably not less than 0.3 parts by mass and not greater than 1 part by mass based on 100 parts by mass of the rubber component.

Examples of the accelerating agent for the thiourea crosslinking agent include guanidine accelerating agents such as 1,3-diphenylguanidine (D), 1,3-di-o-tolylguanidine (DT) and 1-o-tolylbiguanide (BG), which may be used alone or in combination.

The proportion of the accelerating agent to be blended is preferably not less than 0.3 parts by mass and not greater than 1 part by mass based on 100 parts by mass of the overall rubber component in order to sufficiently provide the effect of accelerating the crosslinking of the epichlorohydrin rubber.

(Sulfur Crosslinking Agent and Accelerating Agent)

At least one of sulfur and a sulfur-containing crosslinking agent is used as the sulfur crosslinking agent.

Various organic compounds each containing sulfur in a molecule thereof and functioning as the crosslinking agent for the diene rubber and the GECO are usable as the sulfur-containing crosslinking agent. An example of the sulfur-containing crosslinking agent is 4,4'-dithiodimorpholine (R).

Particularly, sulfur is preferred as the sulfur crosslinking agent.

In order to properly cross link the diene rubber and to impart the semiconductive roller with rubber characteristic properties, i.e., to ensure that the semiconductive roller is flexible and substantially free from the permanent compressive deformation with a reduced compression set, the proportion of the sulfur to be blended is preferably not less than 1 part by mass and not greater than 2 parts by mass based on 100 parts by mass of the overall rubber component.

Where the sulfur-containing crosslinking agent is used as the crosslinking agent, the proportion of the sulfur-containing crosslinking agent is preferably adjusted so that the proportion of sulfur contained in the molecule of the sulfur-containing crosslinking agent falls within the aforementioned range based on 100 parts by mass of the overall rubber component.

Examples of the accelerating agent for the sulfur crosslinking agent include sulfur-containing accelerating agents such as a thiazole accelerating agent, a thiuram accelerating agent, a sulfenamide accelerating agent and a dithiocarbamate accelerating agent each having sulfur in a molecule thereof. These sulfur-containing accelerating agents may be used alone or in combination.

Among these accelerating agents, the thiazole accelerating agent and the thiuram accelerating agent are preferably used in combination.

Examples of the thiazole accelerating agent include 2-mercaptobenzothiazole (M), di-2-benzothiazolyl disulfide (DM), a zinc salt of 2-mercaptobenzothiazole (MZ), a cyclohexylamine salt of 2-mercaptobenzothiazole (HM, M60-OT), 2-(N,N-diethylthiocarbamoylthio)benzothiazole (64) and 2-(4'-morpholinodithio)benzothiazole (DS, MDB), which may be used alone or in combination. Particularly, di-2-benzothiazolyl disulfide (DM) is preferred.

Examples of the thiuram accelerating agent include tetramethylthiuram monosulfide (TS), tetramethylthiuram disulfide (TT, TMT), tetraethylthiuram disulfide (TET), tetrabutylthiuram disulfide (TBT), tetrakis(2-ethylhexyl)thiuram disulfide (TOT-N) and dipentamethylenethiuram tetrasulfide (TRA), which may be used alone or in combination. Particularly, tetramethylthiuram monosulfide (TS) is preferred.

Where two types of sulfur-containing accelerating agents are used in combination, the proportion of the thiazole accelerating agent to be blended is preferably not less than 1 part by mass and not greater than 2 parts by mass based on 100 parts by mass of the overall rubber component in order to sufficiently provide the effect of accelerating the crosslinking of the diene rubber. Similarly, the proportion of the thiuram accelerating agent to be blended is preferably not less than 0.3 parts by mass and not greater than 0.9 parts by mass based on 100 parts by mass of the overall rubber component.

<Other Ingredients>

As required, the semiconductive rubber composition may further contain various additives. Examples of the additives include an acceleration assisting agent, an acid accepting agent, a plasticizing agent, a processing aid, a degradation preventing agent, a filler other than the titanium oxide, an anti-scorching agent, a lubricant, a pigment, an anti-static agent, a flame retarder, a neutralizing agent, a nucleating agent and a co-crosslinking agent.

The types and the proportions of these additives to be blended may be determined particularly in consideration of proper balance between the resistance of the semiconductive roller and the effect of suppressing the adhesion and the accumulation of the external additives on the outer peripheral surface.

Examples of the acceleration assisting agent include metal compounds such as zinc white, fatty acids such as stearic acid, oleic acid and cotton seed fatty acids, and other conventionally known acceleration assisting agents, which may be used alone or in combination.

The proportions of these acceleration assisting agents to be blended are preferably each not less than 0.1 part by mass and not greater than 7 parts by mass, particularly preferably not less than 0.5 parts by mass and not greater than 5 parts by mass, based on 100 parts by mass of the overall rubber component.

In the presence of the acid accepting agent, chlorine-containing gases generated from the epichlorohydrin rubber and the CR during the crosslinking of the rubber component are prevented from remaining in the semiconductive roller. Thus, the acid accepting agent functions to prevent the inhibition of the crosslinking and the contamination of the photoreceptor body, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where the hydrotalcites are used in combination with magnesium oxide or potassium oxide, a higher acid accepting effect can be provided, thereby more reliably preventing the contamination of the photoreceptor body.

The proportion of the acid accepting agent to be blended is preferably not less than 0.5 parts by mass and not greater than 6 parts by mass, particularly preferably not less than 1 part by mass and not greater than 5 parts by mass, based on 100 parts by mass of the overall rubber component.

Examples of the plasticizing agent include plasticizers such as dibutyl phthalate (DBP), dioctyl phthalate (DOP) and tricresyl phosphate, and waxes such as polar waxes. Examples of the processing aid include fatty acids such as stearic acid.

The proportion of the plasticizing agent and/or the processing aid to be blended is preferably not greater than 5 parts by mass based on 100 parts by mass of the overall rubber component. This prevents the contamination of the photoreceptor body, for example, when the semiconductive roller is mounted in an image forming apparatus or when the image forming apparatus is operated. For this purpose, it is preferred to use any of the polar waxes out of the plasticizing agents.

Examples of the degradation preventing agent include various anti-aging agents and anti-oxidants.

The anti-oxidants serve to reduce the environmental dependence of the roller resistance of the semiconductive roller and to suppress the increase in roller resistance during continuous energization of the semiconductive roller. Examples of the anti-oxidants include nickel diethyldithiocarbamate (NOCRAC (registered trade name) NEC-P available from Ouchi Shinko Chemical Industrial Co., Ltd.) and nickel dibutyldithiocarbamate (NOCRAC NBC available from Ouchi Shinko Chemical Industrial Co., Ltd.)

Other examples of the filler include zinc oxide, silica, carbon, carbon black, clay, talc, calcium carbonate, magnesium carbonate and aluminum hydroxide, which may be used alone or in combination.

The blending of the filler improves the mechanical strength and the like of the semiconductive roller.

The proportion of the filler to be blended is preferably not less than 5 parts by mass and not greater than 25 parts by mass, particularly preferably not greater than 20 parts by mass, based on 100 parts by mass of the overall rubber component.

An electrically conductive filler such as electrically conductive carbon black may be blended as the filler to impart the semiconductive roller with electron conductivity.

A preferred example of the electrically conductive carbon black is HAF. The HAF can be uniformly dispersed in the semiconductive rubber composition and, therefore, impart the semiconductive roller with more uniform electron conductivity.

The proportion of the electrically conductive carbon black to be blended is preferably not less than 1 part by mass and not greater than 8 parts by mass, particularly preferably not less than 3 parts by mass and not greater than 6 parts by mass, based on 100 parts by mass of the overall rubber component.

Examples of the anti-scorching agent include N-cyclohexylthiophthalimide, phthalic anhydride, N-nitrosodiphenylamine and 2,4-diphenyl-4-methyl-1-pentene, which may be used alone or in combination. Particularly, N-cyclohexylthiophthalimide is preferred.

The proportion of the anti-scorching agent to be blended is preferably not less than 0.1 part by mass and not greater than 5 parts by mass, particularly preferably not greater than 1 part by mass, based on 100 parts by mass of the overall rubber component.

The co-crosslinking agent serves to crosslink itself as well as the rubber component to increase the overall molecular weight.

Examples of the co-crosslinking agent include ethylenically unsaturated monomers typified by methacrylic esters, metal salts of methacrylic acid and acrylic acid, polyfunctional polymers utilizing functional groups of 1,2-polybutadienes, and dioximes, which may be used alone or in combination.

Examples of the ethylenically unsaturated monomers include:

(a) monocarboxylic acids such as acrylic acid, methacrylic acid and crotonic acid;
(b) dicarboxylic acids such as maleic acid, fumaric acid and itaconic acid;
(c) esters and anhydrides of the unsaturated carboxylic acids (a) and (b);
(d) metal salts of the monomers (a) to (c);
(e) aliphatic conjugated dienes such as 1,3-butadiene, isoprene and 2-chloro-1,3-butadiene;
(f) aromatic vinyl compounds such as styrene, α-methylstyrene, vinyltoluene, ethylvinylbenzene and divinylbenzene;
(g) vinyl compounds such as triallyl isocyanurate, triallyl cyanurate and vinylpyridine each having a hetero ring; and
(h) cyanovinyl compounds such as (meth)acrylonitrile and α-chloroacrylonitrile, acrolein, formyl sterol, vinyl methyl ketone, vinyl ethyl ketone and vinyl butyl ketone.

These ethylenically unsaturated monomers may be used alone or in combination.

Monocarboxylic acid esters are preferred as the esters (c) of the unsaturated carboxylic acids.

Specific examples of the monocarboxylic acid esters include:

alkyl (meth)acrylates such as methyl (meth)acrylate, ethyl (meth)acrylate, n-propyl (meth)acrylate, i-propyl (meth) acrylate, n-butyl (meth)acrylate, i-butyl (meth)acrylate, n-pentyl (meth)acrylate, i-pentyl (meth)acrylate, n-hexyl (meth)acrylate, cyclohexyl (meth)acrylate, 2-ethylhexyl (meth)acrylate, octyl (meth)acrylate, i-nonyl (meth)acrylate, tert-butylcyclohexyl (meth)acrylate, decyl (meth)acrylate, dodecyl (meth)acrylate, hydroxymethyl (meth)acrylate and hydroxyethyl (meth)acrylate;

aminoalkyl (meth)acrylates such as aminoethyl (meth) acrylate, dimethylaminoethyl (meth)acrylate and butylaminoethyl (meth)acrylate;

(meth)acrylates such as benzyl (meth)acrylate, benzoyl (meth)acrylate and aryl (meth)acrylates each having an aromatic ring;

(meth) acrylates such as glycidyl (meth) acrylate, methaglycidyl (meth)acrylate and epoxycyclohexyl (meth)acrylate each having an epoxy group;

(meth)acrylates such as N-methylol (meth) acrylamide, γ-(meth)acryloxypropyltrimethoxysilane and tetrahydrofurfuryl methacrylate each having a functional group; and polyfunctional (meth)acrylates such as ethylene glycol di(meth)acrylate, trimethylolpropane tri(meth)acrylate, ethylene dimethacrylate (EDMA), polyethylene glycol dimethacrylate and isobutylene ethylene dimethacrylate. These monocarboxylic acid esters may be used alone or in combination.

The semiconductive rubber composition containing the ingredients described above can be prepared in a conventional manner. First, the rubbers for the rubber component are blended in the predetermined proportions, and the resulting rubber component is simply kneaded. After the potassium salt, the titanium oxide and additives other than the crosslinking component are added to and kneaded with the rubber component, the crosslinking component is finally added to and further kneaded with the resulting mixture. Thus, the semiconductive rubber composition is provided. A sealed kneading machine such as an Intermix mixer, a Banbury mixer, a kneader or an extruder, an open roll or the like, for example, is usable for the kneading.

<<Semiconductive Roller>>

FIG. 1 is a perspective view of a semiconductive roller according to one embodiment of the present invention.

Referring to FIG. 1, the semiconductive roller 1 according to this embodiment includes a tubular body formed from the aforementioned semiconductive rubber composition and having a single layer structure, and a is inserted through a center through-hole 2 of the tubular body and fixed to the through-hole 2.

The shaft 3 is made of a metal such as aluminum, an aluminum alloy or a stainless steel.

The shaft 3 is electrically connected to and mechanically fixed to the semiconductive roller 1, for example, via an electrically conductive adhesive agent. Alternatively, a shaft having an outer diameter that is greater than the inner diameter of the through-hole 2 is used as the shaft 3, and press-inserted into the through-hole 2 to be electrically connected to and mechanically fixed to the semiconductive roller 1. Thus, the shaft 3 and the semiconductive roller 1 are unitarily rotatable.

The semiconductive roller 1 may have an oxide film 5 provided in an outer peripheral surface 4 thereof as shown in FIG. 1 on an enlarged scale.

The use of the semiconductive rubber composition having the aforementioned formulation for the production of the semiconductive roller 1 and the provision of the oxide film 5 create the following synergistic effects. The semiconductive roller 1 can uniformly charge the surface of the photoreceptor body particularly when being used as the charging roller. Further, the semiconductive roller 1 is substantially free from the defective image formation due to the adhesion and the accumulation of the external additives and the contamination of the photoreceptor body, even if repeatedly performing the charging operation. In addition, the semiconductive roller 1 has a lower roller resistance, making it possible to form higher-definition images at a higher process speed.

The oxide film 5 can be easily formed, for example, by irradiation with ultraviolet radiation in an oxidizing atmosphere. This suppresses the reduction in the productivity of the semiconductive roller 1 and the increase in the production costs of the semiconductive roller 1.

For the production of the semiconductive roller 1, the semiconductive rubber composition preliminarily prepared is first extruded into a tubular body by means of an extruder. Then, the tubular body is cut to a predetermined length, and heated in a vulcanization can to crosslink the rubber component.

In turn, the tubular body thus crosslinked is heated in an oven for secondary crosslinking, then cooled, and polished to a predetermined outer diameter.

Various polishing methods such as dry traverse polishing method may be used for the polishing.

Further, the oxide film 5 is formed in the outer peripheral surface 4, for example, by the irradiation with the ultraviolet radiation in the oxidizing atmosphere. Thus, the semiconductive roller 1 is produced.

The shaft 3 may be inserted into and fixed to the through-hole 2 at anytime between the end of the cutting of the tubular body and the end of the polishing.

However, the tubular body is preferably secondarily crosslinked and polished with the shaft 3 inserted through the through-hole 2 after the cutting. This prevents warpage and deformation of the semiconductive roller 1 which may otherwise occur due to expansion and contraction of the tubular body in the secondary crosslinking. Further, the tubular body may be polished while being rotated about the shaft 3. This improves the working efficiency in the polishing, and suppresses deflection of the outer peripheral surface 4.

As previously described, the shaft 3 may be inserted through the through-hole 2 of the tubular body with the intervention of the electrically conductive adhesive agent (particularly, a thermosetting adhesive agent) before the secondary crosslinking, or the shaft 3 having an outer diameter greater than the inner diameter of the through-hole 2 may be press-inserted into the through-hole 2.

In the former case, the thermosetting adhesive agent is cured when the tubular body is secondarily crosslinked by the heating in the oven. Thus, the shaft 3 is electrically connected to and mechanically fixed to the semiconductive roller 1.

In the latter case, the electrical connection and the mechanical fixing are achieved simultaneously with the press insertion.

Alternatively, the semiconductive roller 1 may be produced by press-molding and crosslinking the semiconductive rubber composition in a mold having a three-dimensional shape conformal to the semiconductive roller 1 to form a tubular body, and forming the oxide film 5 in the outer peripheral surface 4, for example, by the irradiation with the ultraviolet radiation in the oxidizing atmosphere.

In the press-molding, the shaft 3 may be set in a predetermined position in the press-molding mold, for example, with an electrically conductive thermo-setting adhesive agent applied to the outer peripheral surface thereof, whereby the shaft 3 is electrically connected to and mechanically fixed to the semiconductive roller 1 simultaneously with the press-molding and the crosslinking of the semiconductive rubber composition.

As in the aforementioned case, the shaft 3 may be inserted through the through-hole 2 of the semiconductive roller 1 thus press-molded in the tubular shape to be electrically connected to and mechanically fixed to the semiconductive roller 1, for example, via the electrically conductive adhesive agent, or the shaft 3 having an outer diameter greater than the inner diameter of the through-hole 2 may be press-inserted into the through-hole 2 to be electrically connected to and mechanically fixed to the semiconductive roller 1.

The semiconductive roller 1 may have a double-layer structure which includes an outer layer provided on the side of the outer peripheral surface 4 and an inner layer provided on the side of the shaft 3. Further, the semiconductive roller 1 may have a porous structure.

However, the semiconductive roller 1 preferably has a nonporous single-layer structure for simplification of the structure thereof for production at lower costs with higher productivity, for improvement of the durability thereof and for minimization of the compression set thereof.

The term "single-layer structure" herein means that the semiconductive roller 1 includes a single layer formed from the rubber composition and the oxide film 5 formed by the oxidation process is not counted.

Where the semiconductive roller 1 is used as the charging roller, the semiconductive roller 1 preferably has a roller resistance of not greater than $10^{5.5}\Omega$ in order to form higher-definition images at a higher process speed as described above. It is noted that the roller resistance of the semiconductive roller 1 is a roller resistance measured with the oxide film 5 formed in the outer peripheral surface 4.

<<Method for Measuring Roller Resistance>>

Figure 2:
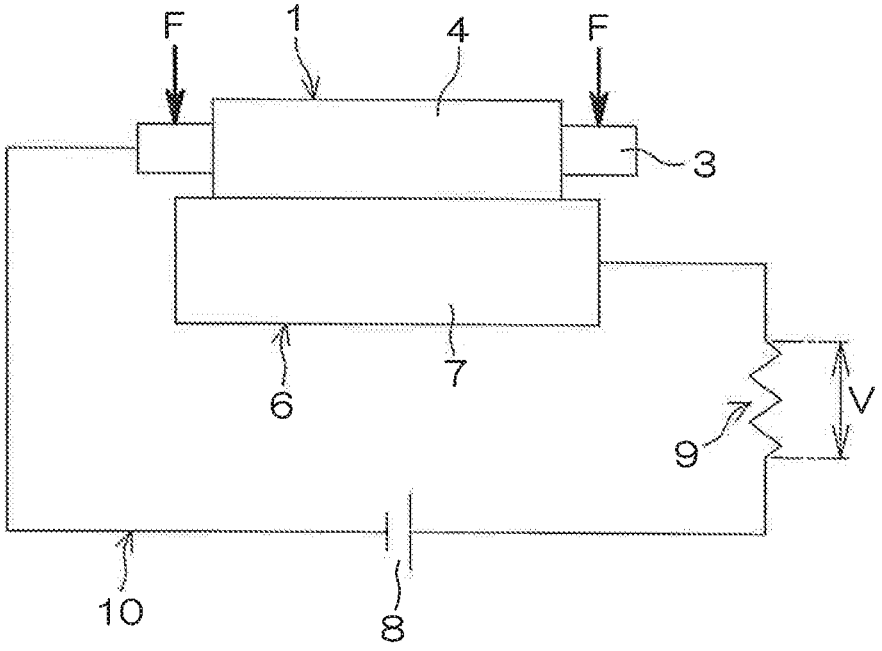
FIG. 2 is a diagram for explaining how to measure the roller resistance of the semiconductive roller.

FIG. 2 is a diagram for explaining how to measure the roller resistance of the semiconductive roller 1.

Referring to FIGS. 1 and 2, the roller resistance of the semiconductive roller 1 is measured in the following manner in an ordinary temperature and ordinary humidity environment at a temperature of 23° C. at a relative humidity of 55% with an application voltage of 200 V in the present invention.

An aluminum drum 6 rotatable at a constant rotation speed is prepared, and the outer peripheral surface 4 (formed with the oxide film 5) of the semiconductive roller 1 to be subjected to the measurement of the roller resistance is brought into contact with an outer peripheral surface 7 of the aluminum drum 6 from above.

A DC power source 8 and a resistor 9 are connected in series between the shaft 3 of the semiconductive roller 1 and the aluminum drum 6 to provide a measurement circuit 10. The DC power source 8 is connected to the shaft 3 at its negative terminal, and connected to the resistor 9 at its positive terminal. The resistor 9 has a resistance r of 100Ω.

Subsequently, a load F of 450 g is applied to each of opposite end portions of the shaft 3 to bring the semiconductive roller 1 into press contact with the aluminum drum 6 and, in this state, a detection voltage V applied to the resistor 9 is measured by applying an application voltage E of DC 200 V from the DC power source 8 between the shaft 3 and the aluminum drum 6 while rotating the aluminum drum 6 (at a rotation speed of 40 rpm).

The roller resistance R of the semiconductive roller 1 is basically determined from the following expression (i') based on the detection voltage V and the application voltage E (=200 V):

$$R=r\times E/(V-r) \quad \text{(i')}$$

However, the term −r in the denominator of the expression (i') is negligible, so that the roller resistance of the semiconductive roller 1 is expressed by a value determined from the following expression (i) in the present invention:

$$R=r\times E/V \quad \text{(i)}$$

As described above, a temperature of 23° C. and a relative humidity of 55% are employed as conditions for the measurement.

The hardness and the compression set of the semiconductive roller 1 can be controlled according to the use purpose of the semiconductive roller 1. The control of the hardness, the compression set, the roller resistance and the like can be achieved, for example, by controlling the mass ratio of the epichlorohydrin rubber, the CR and the NBR within the aforementioned range, controlling the types and the amounts of the substances of the crosslinking component, and controlling the amount of the titanium oxide (filler) and the types and the amounts of the potassium salt (electrically conductive agent) and the other ingredients.

The inventive semiconductive roller 1 can be advantageously used not only as the charging roller but also as a developing roller, a transfer roller, a cleaning roller and the like in an electrophotographic image forming apparatus such as a laser printer, an electrostatic copying machine, a plain paper facsimile machine or a printer-copier-facsimile multifunction machine.

EXAMPLES

Example 1

(Preparation of Semiconductive Rubber Composition)

The following rubbers were blended for preparation of a rubber component.

(A) 60 parts by mass of a GECO (EPION (registered trade name) 301L available from Daiso Co., Ltd. and having a molar ratio of EO/EP/AGE=73/23/4)

(B) 20 parts by mass of a CR (SHOPRENE (registered trade name) WRT available from Showa Denko K.K.)

(C) 20 parts by mass of an NBR (lower acrylonitrile content NBR JSR (registered trade name) N250SL available from JSR Co., Ltd. and having an acrylonitrile content of 20%)

While 100 parts by mass of the rubber component containing the rubbers (A) to (C) was simply kneaded by means of a Banbury mixer, 2 parts by mass of potassium bis (trifluoromethanesulfonyl)imide (potassium salt EF-N112 available from Mitsubishi Materials Electronic Chemicals Co., Ltd.), 20 parts by mass of titanium oxide of the anatase form (KA-20 available from Titan Kogyo, Ltd.), 5 parts by mass of hydrotalcites (acid accepting agent DHT-4A (registered trade name) 2 available from Kyowa Chemical Industry Co., Ltd.) and 5 parts by mass of zinc oxide type-2 (crosslinking assisting agent available from Mitsui Mining & Smelting Co., Ltd.) were blended and kneaded together.

While the resulting mixture was continuously kneaded, the following crosslinking component was further added to and kneaded with the mixture. Thus, the semiconductive rubber composition was prepared. The proportion of the GECO was 60 mass % based on the overall amount of the rubber component.

TABLE 1

| Ingredients | Parts by mass |
|---|---|
| Thiourea crosslinking agent | 0.60 |
| Accelerating agent DT | 0.54 |
| Sulfur powder | 1.50 |
| Accelerating agent DM | 1.50 |
| Accelerating agent TS | 0.50 |

The ingredients shown in Table 1 are as follows. The proportions (parts by mass) shown in Table 1 are based on 100 parts by mass of the overall rubber component.

Thiourea crosslinking agent: Ethylene thiourea (2-mercaptoimidazoline ACCEL (registered trade name) 22-S available from Kawaguchi Chemical Industry Co., Ltd.)

Accelerating agent DT: 1,3-di-o-tolylguanidine (guanidine accelerating agent NOCCELER (registered trade name) DT available from Ouchi Shinko Chemical Industrial Co., Ltd.)

Sulfur powder: Crosslinking agent (available from Tsurumi Chemical Industry Co., Ltd.)

Accelerating agent DM: Di-2-benzothiazolyl disulfide (thiazole accelerating agent NOCCELER DM available from Ouchi Shinko Chemical Industrial Co., Ltd.)

Accelerating agent TS: Tetramethylthiuram monosulfide (thiuram accelerating agent NOCCELER TS available from Ouchi Shinko Chemical Industrial Co., Ltd.)

(Production of Semiconductive Roller)

The semiconductive rubber composition thus prepared was fed into a ϕ60 extruder, and extruded into a tubular body having an outer diameter of 10 mm and an inner diameter of 5 mm. Then, the tubular body was fitted around a temporary crosslinking shaft, and crosslinked in a vulcanization can at 160° C. for 30 minutes.

Then, the crosslinked tubular body was removed from the temporary shaft, then fitted around a shaft having an outer diameter of 6 mm and an outer peripheral surface to which an electrically conductive thermosetting adhesive agent (polyamide adhesive agent) was applied, and heated in an oven at 150° C. for 60 minutes. Thus, the tubular body was bonded to the shaft. In turn, opposite end portions of the tubular body were cut, and the outer peripheral surface of the resulting tubular body was dry-polished to an outer diameter of 8.5 mm by means of a wide polishing machine.

After the polished outer peripheral surface was wiped with an alcohol, the tubular body was set in a UV treatment apparatus with the outer peripheral surface spaced 50 mm from a UV light source. Then, the outer peripheral surface was irradiated with ultraviolet radiation for 5 minutes while the tubular body was rotated at 30 rpm, whereby an oxide film was formed in the outer peripheral surface. Thus, a semiconductive roller was produced.

Example 2

A semiconductive rubber composition was prepared in substantially the same manner as in Example 1, except that titanium oxide of the rutile form (KR-380 available from Titan Kogyo, Ltd.) was blended in the same proportion. Then, a semiconductive roller was produced in the same manner as in Example 1 by using the semiconductive rubber composition thus prepared.

Comparative Example 1

A semiconductive rubber composition was prepared in substantially the same manner as in Example 1, except that the titanium oxide was not blended. Then, a semiconductive roller was produced in the same manner as in Example 1 by using the semiconductive rubber composition thus prepared.

Examples 3 and 4, and Comparative Examples 2 and 3

Semiconductive rubber compositions were prepared in substantially the same manner as in Example 1, except that the titanium oxide of the anatase form was blended in proportions of 4 parts by mass (Comparative Example 2), 5 parts by mass (Example 3), 50 parts by mass (Example 4) and 60 parts by mass (Comparative Example 3) based on 100 parts by mass of the overall rubber component. Then, semiconductive rollers were produced in the same manner as in Example 1 by using the semiconductive rubber compositions thus prepared.

Example 5

A semiconductive rubber composition was prepared in substantially the same manner as in Example 1, except that the rubber component contained 15 parts by mass of the GECO, 40 parts by mass of the CR and 45 parts by mass of the NBR. Then, a semiconductive roller was produced in the same manner as in Example 1 by using the semiconductive rubber composition thus prepared.

Example 6

A semiconductive rubber composition was prepared in substantially the same manner as in Example 1, except that the rubber component contained 80 parts by mass of the GECO, 10 parts by mass of the CR and 10 parts by mass of the NBR. Then, a semiconductive roller was produced in the same manner as in Example 1 by using the semiconductive rubber composition thus prepared.

Comparative Example 4

A semiconductive rubber composition was prepared in substantially the same manner as in Example 1, except that the rubber component contained 10 parts by mass of the GECO, 45 parts by mass of the CR and 45 parts by mass of the NBR. Then, a semiconductive roller was produced in the same manner as in Example 1 by using the semiconductive rubber composition thus prepared.

Comparative Example 5

A semiconductive rubber composition was prepared in substantially the same manner as in Example 1, except that the rubber component contained 85 parts by mass of the GECO, 5 parts by mass of the CR and 10 parts by mass of the NBR. Then, a semiconductive roller was produced in the same manner as in Example 1 by using the semiconductive rubber composition thus prepared.

Comparative Example 6

A semiconductive rubber composition was prepared in substantially the same manner as in Example 1, except that lithium bis(trifluoromethanesulfonyl)imide (lithium salt EF-N115 available from Mitsubishi Materials Electronic Chemicals Co., Ltd.) was blended in the same proportion instead of the potassium salt. Then, a semiconductive roller was produced in the same manner as in Example 1 by using the semiconductive rubber composition thus prepared.

<Measurement of Roller Resistance>

The roller resistance of each of the semiconductive rollers produced in Examples and Comparative Examples was measured in an ordinary temperature and ordinary humidity environment at a temperature of 23° C. at a relative humidity of 55% by the aforementioned measurement method. The roller resistance was expressed in the form of log R in Tables 2 and 3.

<Actual Machine Test>

A toner cartridge to be removably mounted in a laser printer (HP Color LaserJet 3800 available from Japan Hewlett Packard Co., Ltd.) and including a photoreceptor body and a charging roller constantly kept in contact with a surface of the photoreceptor body was prepared. The semiconductive rollers produced in Examples and Comparative Examples were each incorporated as a charging roller instead of the original charging roller in the toner cartridge.

Immediately after the toner cartridge was mounted in the laser printer, a halftone image and a solid image were printed in the ordinary temperature and ordinary humidity environment at a temperature of 23° C. at a relative humidity of 55% by means of the laser printer, and visually checked for initial density unevenness based on the following criteria.

○ (Excellent): No density unevenness was observed.

Δ (Practically acceptable): Slight density unevenness was observed.

x (Unacceptable): Density unevenness was observed.

Another toner cartridge prepared in the aforementioned manner was incorporated in the laser printer. After sheets were passed through the toner cartridge at a rate of 2000 sheets per day in a lower temperature and lower humidity environment at a temperature of 10° C. at a relative humidity of 20% for 7 days. Then, a halftone image and a solid image were printed, and visually checked for density unevenness based on the following criteria.

○ (Excellent): No density unevenness was observed.

Δ (Practically acceptable): Slight density unevenness was observed.

x (Unacceptable): Density unevenness was observed.

Further another toner cartridge prepared in the aforementioned manner was allowed to stand still in a higher temperature and higher humidity environment at a temperature of 50° C. at a relative humidity of 90% for 14 days, and then incorporated in the laser printer. Then, half tone images and solid images were sequentially printed, and visually checked for contamination of the photoreceptor body and permanent compressive deformation of the semiconductive roller.

○ (Excellent): Defective image formation due to the contamination of the photoreceptor body or the permanent compressive deformation of the semiconductive roller was not observed in an image printed first.

Δ (Acceptable): Several images initially printed suffered from defective image formation with a contamination line formed along a part thereof in association with a surface portion of the photoreceptor body kept in contact with the semiconductive roller when the semiconductive roller was allowed to stand still, but no contamination line was observed in images thereafter printed. The defective image formation was supposedly because of contamination with moisture absorbed in the roller or slight compressive deformation of the roller.

x (Unacceptable): An image printed first suffered from defective image formation with a contamination line formed along the aforementioned part. Even after 20 or more images were sequentially printed, this phenomenon was still observed. The defective image formation was supposedly because of contamination with substances bleeding or blooming on the outer peripheral surface of the semiconductive roller or great compressive deformation of the roller.

The results are shown in Tables 2 and 3.

TABLE 2

| | Example 1 | Example 2 | Example 3 | Example 4 | Example 5 | Example 6 |
|---|---|---|---|---|---|---|
| Rubber Component (parts by mass) | | | | | | |
| GECO | 60 | 60 | 60 | 60 | 15 | 80 |
| CR | 20 | 20 | 20 | 20 | 40 | 10 |
| NBR | 20 | 20 | 20 | 20 | 45 | 10 |
| Electrically conductive agent (parts by mass) | | | | | | |
| Potassium salt | 2 | 2 | 2 | 2 | 2 | 2 |
| Lithium salt | — | — | — | — | — | — |
| Titanium oxide (parts by mass) | | | | | | |
| Anatase form | 20 | — | 5 | 50 | 20 | 20 |
| Rutile form | — | 20 | — | — | — | — |
| Evaluation | | | | | | |
| Roller resistance (log R) | 4.9 | 5.0 | 4.7 | 5.1 | 5.4 | 4.5 |
| Actual machine test | | | | | | |
| Initial density unevenness | ○ | ○ | ○ | ○ | ○ | ○ |
| Density unevenness after passage of sheets | ○ | Δ | Δ | ○ | Δ | ○ |
| Contamination of photoreceptor or compressive deformation | ○ | ○ | ○ | Δ | ○ | Δ |

TABLE 3

| | Comparative Example 1 | Comparative Example 2 | Comparative Example 3 | Comparative Example 4 | Comparative Example 5 | Comparative Example 6 |
|---|---|---|---|---|---|---|
| Rubber Component (parts by mass) | | | | | | |
| GECO | 60 | 60 | 60 | 10 | 85 | 60 |
| CR | 20 | 20 | 20 | 45 | 5 | 20 |
| NBR | 20 | 20 | 20 | 45 | 10 | 20 |
| Electrically conductive agent (parts by mass) | | | | | | |
| Potassium salt | 2 | 2 | 2 | 2 | 2 | — |
| Lithium salt | — | — | — | — | — | 2 |
| Titanium oxide (parts by mass) | | | | | | |
| Anatase form | — | 4 | 60 | 20 | 20 | 20 |
| Rutile form | — | — | — | — | — | — |
| Evaluation | | | | | | |
| Roller resistance (log R) | 4.6 | 4.7 | 5.3 | 5.7 | 4.5 | 4.4 |
| Actual machine test | | | | | | |
| Initial density unevenness | ○ | ○ | ○ | ○ | ○ | ○ |
| Density unevenness after passage of sheets | x | x | Δ | x | Δ | ○ |
| Contamination of photoreceptor or compressive deformation | ○ | ○ | x | ○ | x | x |

The results for the inventive examples and the comparative examples shown in Tables 2 and 3 indicate that, where the semiconductive roller is formed from the semiconductive rubber composition which contains the rubber component including 15 to 80 mass % of the epichlorohydrin rubber, 5 to 50 parts by mass of the titanium oxide based on 100 parts by mass of the overall rubber component and a potassium salt as the electrically conductive agent, and has the oxide film formed in the outer peripheral surface thereof, the semiconductive roller is capable of uniformly electrically charging the surface of the photoreceptor body particularly when being used as the charging roller, substantially free from the defective image formation due to the adhesion and the accumulation of the external additives even if repeatedly performing the charging operation, and less liable to contaminate the photoreceptor body, and has a lower roller resistance to make it possible to form higher-definition images at a higher process speed.

The results for Examples 1 to 6 indicate that, for further improvement of the aforementioned effects, the proportion of the epichlorohydrin rubber in the rubber component is preferably not less than 50 mass % and not greater than 70 mass %.

The results for Examples 1 to 6 indicate that, for further improvement of the aforementioned effects, the titanium oxide of the anatase form is more preferred than the titanium oxide of the rutile form, and the proportion of the titanium oxide is preferably not less than 10 parts by mass and not greater than 30 parts by mass based on 100 parts by mass of the overall rubber component.

This application corresponds to Japanese Patent Application No. 2015-053726 filed in the Japan Patent Office on Mar. 17, 2015, the disclosure of which is incorporated herein by reference in its entirety.

What is claimed is:

1. A semiconductive roller comprising:

a roller body formed from a semiconductive rubber composition; and an oxide film provided in an outer peripheral surface of the roller body;

wherein the semiconductive rubber composition comprises:

a rubber component comprising an epichlorohydrin rubber and a diene rubber;

an electrically conductive agent comprising a potassium salt of an anion having a fluoro group and a sulfonyl group in its molecule;

titanium oxide; and a crosslinking component for crosslinking the rubber component;

wherein the epichlorohydrin rubber is present in a proportion of not less than 15 mass % and not greater than 80 mass % in the rubber component;

wherein the titanium oxide is titanium oxide having an anatase-form crystal structure, and is present in a proportion of not less than 5 parts by mass and not greater than 50 parts by mass based on 100 parts by mass of the overall rubber component in the semiconductive rubber composition.

2. The semiconductive roller according to claim 1, wherein the electrically conductive agent comprises potassium bis(fluorosulfonyl)imide.

3. The semiconductive roller according to claim 1, wherein the oxide film is an oxide film formed by irradiation with ultraviolet radiation.

4. The semiconductive roller according to claim 1, wherein the crosslinking component comprises a thiourea crosslinking agent, a sulfur crosslinking agent, an accelerating agent for the thiourea crosslinking agent, and an accelerating agent for the sulfur crosslinking agent.

5. The semiconductive roller according to claim 1, which is incorporated in an electrophotographic image forming apparatus as a charging roller for electrically charging a surface of a photoreceptor body.

* * * * *